219-121 SR
2/23/88 OR 4,727,233

United States Patent [19]
Pavese et al.

[11] Patent Number: 4,727,233
[45] Date of Patent: Feb. 23, 1988

[54] METHOD FOR SEALING TUBES

[75] Inventors: Franco Pavese; Danilo Ferri, both of Turin, Italy

[73] Assignee: Consiglio Nazionale Delle Ricerche, Rome, Italy

[21] Appl. No.: 898,984

[22] Filed: Aug. 22, 1986

[51] Int. Cl.[4] ..... B23K 9/00
[52] U.S. Cl. ..... 219/121 PK; 219/137 R; 219/78.16; 228/60
[58] Field of Search ..... 219/78.16, 137 R, 121 PY, 219/121 PK, 121 PJ, 160, 161; 228/60

[56] References Cited

U.S. PATENT DOCUMENTS

| | | | |
|---|---|---|---|
| 2,554,328 | 5/1951 | Grimes | 219/78.16 |
| 2,568,911 | 9/1951 | Cox et al. | 228/60 |
| 2,776,473 | 1/1957 | Dailey et al. | 228/60 |
| 2,851,580 | 9/1958 | Taylor | 228/60 |
| 3,251,525 | 5/1966 | Zietz | 228/60 |
| 3,415,977 | 12/1968 | Bush | 228/60 |
| 3,444,348 | 5/1969 | Goodman | 219/78.16 |
| 4,204,378 | 5/1980 | Thompson | 228/60 |

FOREIGN PATENT DOCUMENTS

| | | | |
|---|---|---|---|
| 0494518 | 4/1938 | United Kingdom | 228/60 |

*Primary Examiner*—M. H. Paschall
*Attorney, Agent, or Firm*—Sughrue, Mion, Zinn, Macpeak, and Seas

[57] ABSTRACT

The method allows the sealing of metal tubes, particularly of stainless steel, for example, tubes for filling containers for gas at high pressure or evacuation tubes for vacuum vessels. It includes the steps of locally squashing the portion of the tube to be sealed with a pressure capable of achieving the sealed clamping of the tube, freeing part of the squashed portion of the tube, the remaining part being maintained under the clamping pressure, cutting the freed part of the squashed portion of the tube, welding the lips of the part which is still clamped, and finally removing the clamping pressure.

3 Claims, 6 Drawing Figures

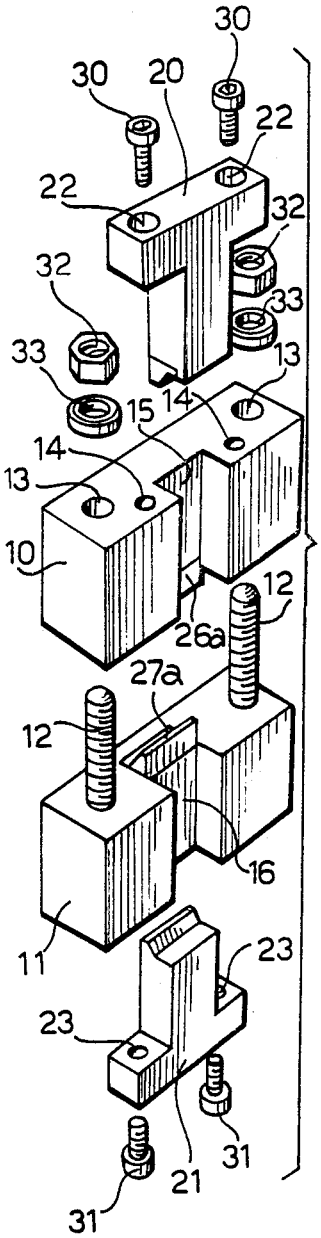
FIG. 4
FIG. 5
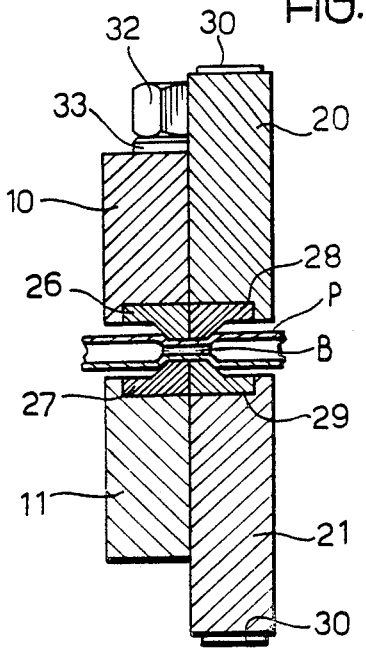
FIG. 6
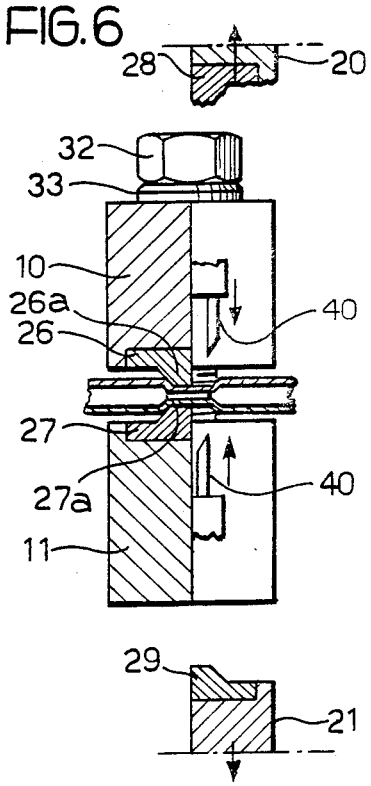

METHOD FOR SEALING TUBES

BACKGROUND OF THE INVENTION

The present invention relates to a method for sealing metal tubes, such as tubes for filling containers for gas at high pressure or evacuation tubes for vacuum vessels.

It is known to seal tubes of malleable metals (for example copper) by simple constriction (pinch) but seals obtained in this manner withstand only modest differences between the internal and external pressures on the tube.

For stainless steel tubes with small internal diameters (about 2 mm at most) it is also known to form the seal by pinching and welding the tube (pinch-weld), possibly after the introduction of a malleable gold wire into the tube to be sealed.

The problem remains of sealing metal tubes with average to large internal diameters and ensuring that a seal is obtained through which losses cannot be detected with a mass-spectrometer leak detector, even at pressures within the tube of up to 20 MPa.

SUMMARY OF THE INVENTION

The object of the present invention provides a new and improved method which overcomes the aforementioned problems.

This object is achieved according to the invention by means of a sealing method characterized in that it comprises the operations of:

locally squashing the portion of the tube to be sealed with a pressure capable of forming a sealed constriction of the tube, freeing part of the squashed portion of the tube, the remaining part being kept under the clamping pressure, cutting the freed part of the squashed portion of the tube, welding the lips of the clamped part of the squashed portion, and finally removing the clamping pressure.

The invention also relates to a vice usable in carrying out this method, characterised in that it comprises a pair of main jaws, a pair of auxiliary jaws adjacent the main ones, and means for enabling the pairs of jaws to be clamped onto and released from a tube to be sealed, together and separately.

Further characteristics and advantages of the invention will become apparent from the detailed description which follows with reference to the appended drawings, provided purely by way of non-limiting example, in which:

BRIEF DESCRIPTION OF THE DRAWINGS

FIG. 4 is an exploded perspective view of the vice shown in FIGS. 2 and 3, and FIGS. 5 and 6 are sectional views similar to that of FIG. 2, showing the vice according to the invention in two different operating conditions.

In FIG. 1, a container for high-pressure gas is indicated 1 and is connected by a tube P to the delivery of a gas supply pump 2. The container 1 and the tube P are, for example, of metal.

DETAILED DESCRIPTION OF THE INVENTION

Once the predetermined quantity of gas has been supplied to the container 1, the latter must be sealed, and this is achieved by the cutting and sealing of the tube P. It is necessary for this sealing operation to be carried out without the escape of gas from the container 1 and without contamination of the gas itself.

In accordance with the invention, if the tube P is of a material with a low ductility, for example stainless steel, a bush of ductile metal having an outer diameter substantially equal to the internal diameter of the tube is inserted beforehand into the zone of the tube which is to be cut and sealed. This bush may, for example, be of soft copper, gold, silver, lead, or their alloys. The bush preferably has an outer diameter such that it can be force-fitted into the tube P.

The thickness of the wall of the bush is preferably equal to about half the thickness of the wall of the tube.

Figure 2:
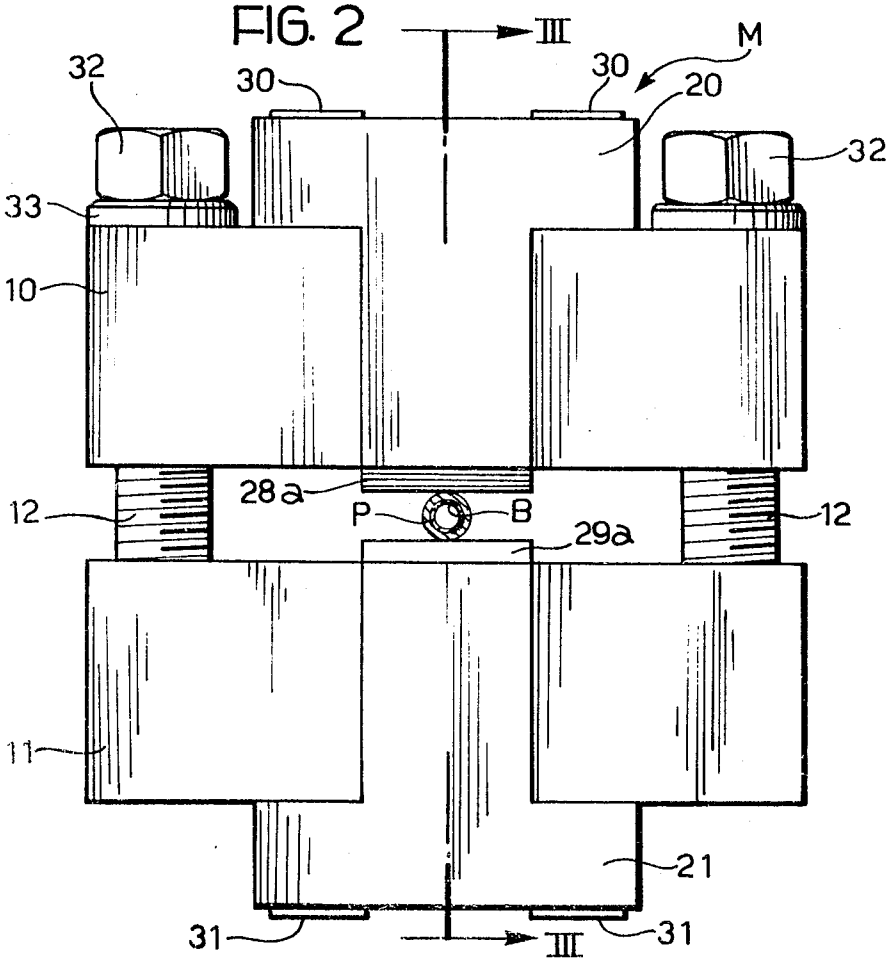
FIG. 2 is a front view of a four-jaw vice according to the invention.

Once the container 1 has been filled, the vice M shown in FIGS. 2 and 6 is disposed around the part of the tube to be sealed. This vice comprises a pair of main jaws 10, 11 essentially in the form of parallelapipedal shaped blocks. Two parallel through- holes 13 (FIG. 4) are formed in the jaw 10, through which extend the shanks 12 of two stud bolts anchored to the other jaw 11. The shanks of these stud bolts are longer than the thickness of the jaw 10. Further threaded holes 14 are formed in the latter adjacent the holes 13. Similar threaded holes are formed in corresponding positions in the lower face of the jaw 11.

The larger side face of the jaw 10 has a groove 15 (FIG. 4) between the holes 14. A corresponding groove 16 is formed in the lower jaw 11.

Auxiliary jaws are indicated 20 and 21. In the embodiment illustrated, these jaws are substantially T-shaped with respective parallel threaded through-holes 22 and 23 formed in the crosspieces.

The main jaws 10 and 11 have respective inserts 26 and 27 of hard material adjacent one end of the respective grooves 15 and 16. These inserts form projecting presser nibs 26*a* and 27*a* arranged parallel to the bottoms of the grooves 15 and 16. These nibs 26*a* and 27*a* have respective larger faces coplanar with the bottoms of the grooves of the respective jaws.

Similarly, the auxiliary jaws 20 and 21 have inserts 28 and 29 at the ends of their respective limbs, forming projecting presser nibs 28*a* and 29*a* parallel to the crosspieces of the jaws. As appears particularly in FIG. 3, for example, the inserts 28 and 29 of the auxiliary jaws are of the same shape as and symmetrical with the inserts 26 and 27 of the main jaws. In particular, they have a flat face coplanar with one of the T-shaped faces of the jaws.

The auxiliary jaws 20 and 21 may be fixed to the main jaws 10 and 11 in the following manner: the limbs of the auxiliary jaws 20 and 21 are inserted and guided in the grooves 15 and 16 of the main jaws until the crosspieces of the auxiliary jaws bear on the surfaces of the main jaws, with the holes 22 and 23 aligned with the threaded holes 14 of the main jaws. The fixing of the auxiliary jaws to the main ones is achieved by means of screws 30 and 31 which extend through the holes in the crosspieces of the auxiliary jaws and engage the threads of the corresponding holes in the main jaws.

Figure 1:
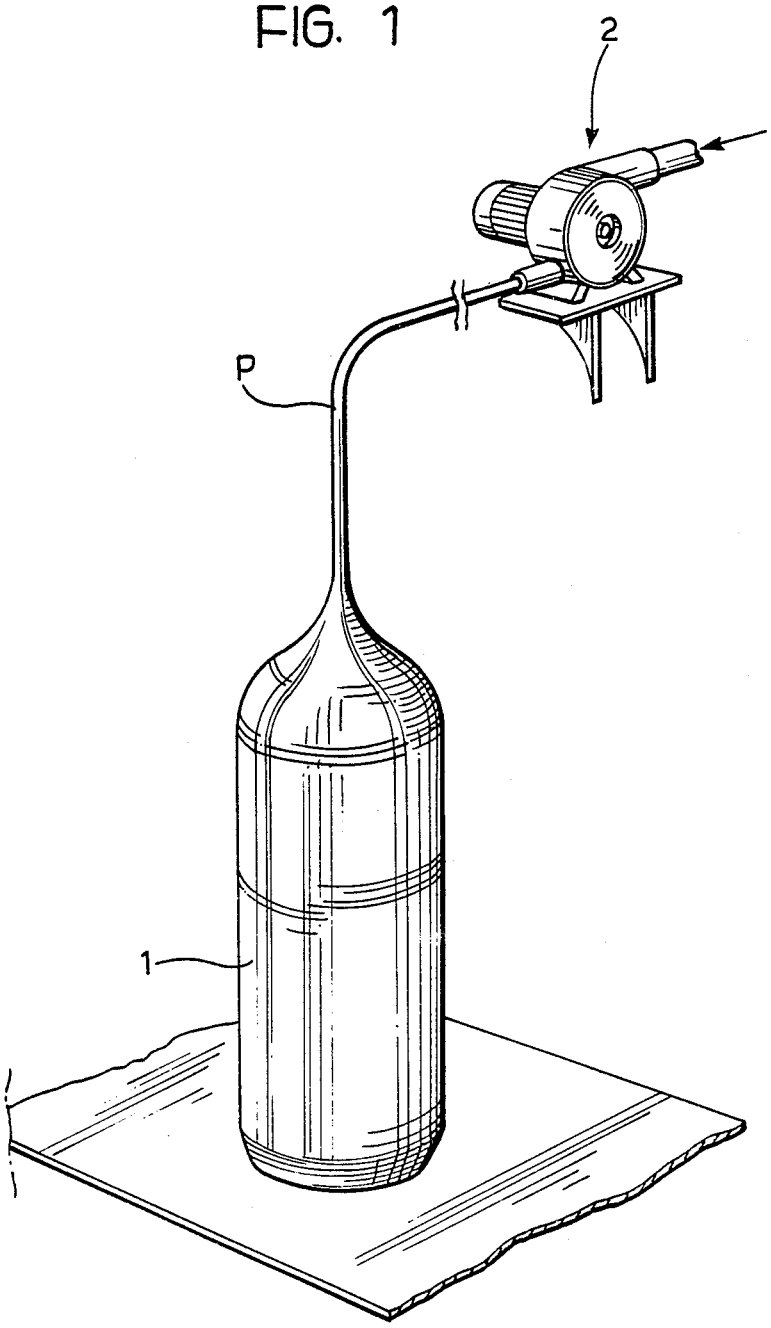
FIG. 1 shows a container for receiving gas at high pressure through a tube which will be sealed after the filling operation by the method of the invention.
Figure 3:
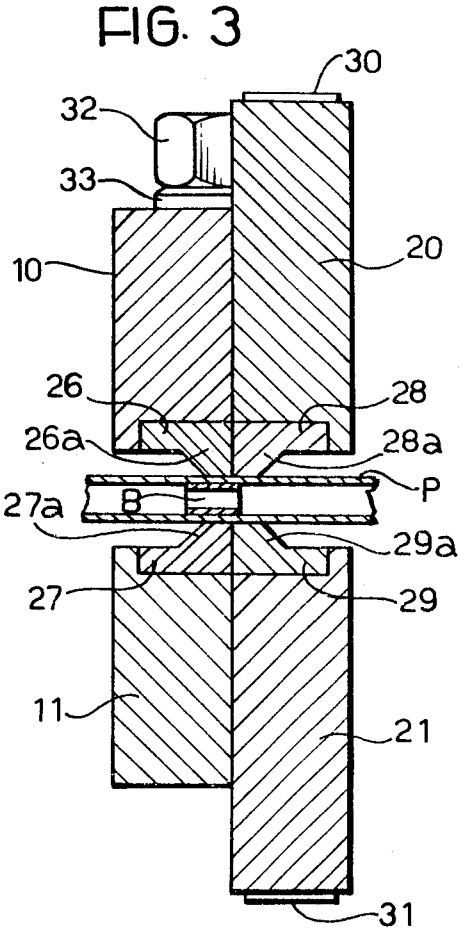
FIG. 3 is a sectional view taken on the line III—III of FIG. 2.

The main jaws 10 and 11 can therefore be mounted on opposite sides of the portion of the tube P in which a bush B of ductile material is inserted, in the manner shown in FIGS. 2 and 3. The presser nibs 26*a*, 28*a* on one side and the nibs 27*a* and 29*a* on the other bear on that zone of the outer surface of the tube in which the bush has been inserted. By means of nuts 32 screwed onto the ends of the stud bolts 12 projecting from the main jaw 10 (after the interposition of washers 33), it is possible to apply a progressively increasing clamping force to the tube P so as to deform the tube and its inserted bush, in the manner shown in FIG. 5, until the completely sealed constriction of the tube and the bush is achieved. Once this condition has been reached, the auxiliary jaws 20 and 21 are removed from the main jaws and taken away (FIG. 6) so as to free part of the squashed portion of the tube P, while the remaining part of the squashed portion remains under the clamping pressure exerted by the main jaws.

The tube P and the bush B are then cut, for example, by means of cutting blades 40 (FIG. 6), in correspondence with the freed part of the squashed portion of the tube P.

The lips of the portion of the tube P gripped between the jaws 10 and 11 are then welded, for example, by plasma-arc welding.

The maintenance of the clamping pressure until the welding is finished ensures that the welding is carried out perfectly without any danger of gas bubbles passing through the material of the squashed bush and being able to create porosity and hence compromise the quality of the weld.

The clamping action exerted by the main jaws also avoids any possibility of contamination of the gas in the container downstream of the constriction.

Once the welding is finished, the main jaws 10 and 11 can be removed.

In the embodiment described above, the method of the invention has been illustrated with reference to the sealing of tubes of material of poor ductility, for example stainless steel. However, the method can also be applied to the sealing of tubes of ductile material, such as copper, and in this case there may not be any need to use a bush of ductile material.

From what has been explained above, it is clear that the invention enables the so-called pinch-weld sealing method to be extended to tubes having average to large diameters. The method of the invention may be applied conveniently in the field of vacuum production where it is necessary to be able to maintain high conductance in the sealing ducts, and in the field of the production of devices for permanently containing gaseous substances at high pressures, thus solving finally the problem of filling capillaries.

Naturally, the principle of the invention remaining the same, the forms of embodiment and details of realisation may be varied widely from that described and illustrated purely by way of non-limiting example, without thereby departing from the scope of the present invention.

We claim:

1. Method for sealing tubes of metal with a poor ductility, comprising:

inserting a bush of ductile metal having an outer diameter substantially equal to the internal diameter of the tube into the tube;

squashing the portion of the tube in which the bush is inserted with a pressure such as to achieve the sealed constriction of the tube and the bush;

freeing part of the squashed portion of the tube while the remaining part is kept under the clamping pressure, the remaining part including part of the bush, cutting off the freed part of the squashed portion of the tube and the bush;

welding the lips of the still-clamped part of the tube and the bush, and removing the clamping pressure.

2. Method according to claim 1, wherein the bush is constituted by one of the following materials: copper, gold, silver, lead, and their alloys.

3. Method according to claim 1, wherein the thickness of the wall of the bush is equal to about half the thickness of the wall of the tube to be sealed.

* * * * *